8-110 SR
FIP8309 XR 4,286,961

United States Patent [19]
Buser et al.

[11] 4,286,961
[45] Sep. 1, 1981

[54] REDUCTION CLEARING OF DISPERSE DYES

[75] Inventors: Rolf Buser, Muttenz, Switzerland; Francis Palacin, Riedisheim, France; Georg Robert; Franz Somm, both of Riehen, Switzerland

[73] Assignee: Sandoz Ltd., Basel, Switzerland

[21] Appl. No.: 63,054

[22] Filed: Aug. 2, 1979

Related U.S. Application Data

[63] Continuation-in-part of Ser. No. 873,132, Jan. 30, 1978, abandoned.

[30] Foreign Application Priority Data

Feb. 4, 1977 [CH] Switzerland ..... 1388/77

[51] Int. Cl.[3] ..... D06P 5/02; D06P 3/872
[52] U.S. Cl. ..... 8/532; 8/529; 8/110; 8/618
[58] Field of Search ..... 8/21 C, 110, 73, 532, 8/618, 529

[56] References Cited

U.S. PATENT DOCUMENTS 4,062,642 12/1977 Deucker, et al. ..... 8/21 C
4,066,390 1/1978 Christie et al. ..... 8/618

FOREIGN PATENT DOCUMENTS 49-124384 11/1974 Japan ..... 8/21 C
51-60788 5/1976 Japan ..... 8/110
1428379 3/1976 United Kingdom ..... 8/21 C

OTHER PUBLICATIONS

Schnider, E. F., Amer. Dyestuff Reporter, May 13, 1963, pp. 52–59.

*Primary Examiner*—Joesph L. Schofer
*Assistant Examiner*—Maria Parrish Tungol
*Attorney, Agent, or Firm*—Gerald D. Sharkin; Richard E. Vila; Thomas C. Doyle

[57] ABSTRACT

The present invention relates to an after-dyeing treatment process for synthetic/cellulosic fibre mixed substrates which have been dyed with at least one disperse and at least one reactive dye in which after fixation, the dyed or printed substrate is reductively treated at a neutral to alkaline pH with an aqueous solution containing reducing agent, whereby non-bound disperse dyestuff is decomposed such that it does not re-build up on the substrate whilst the fixed reactive dyestuff remains substantially unaffected.

23 Claims, No Drawings

REDUCTION CLEARING OF DISPERSE DYES

The present application is a continuation inpart application of application Ser. No. 873,132 filed on Jan. 30, 1978 and now abandoned.

The present invention relates to an after dyeing treatment process for dyed or printed synthetic/cellulosic fibre mixed textile substrates, especially polyester/cellulose mixed textile substrates.

When dyeing or printing a polyester/cellulose mixed textile substrate with a mixture of disperse and reactive dyestuffs, it is invariably the case that, after fixation, unfixed reactive and disperse dye molecules are still present on the substrate. The removal of these unbound dyestuffs causes problems as the fixed dyestuffs must not be deleteriously affected by the removal treatment and the unfixed dyestuff must be effectively removed. Washing removal methods are known but these do not always adequately remove the unbound disperse dyestuff. Furthermore, it is known to protect the reactive dyestuff by applying a resin and subsequently treating the textile with reducing agent to remove unbound disperse dye.

It has now been found that by after-treating a dyed or printed synthetic/cellulosic fibre mixed textile substrate under selected reductive conditions, unfixed disperse and reactive dyestuffs can be removed simultaneously without deleteriously affecting the fixed reactive dyestuff in the absence of a resin protection.

Accordingly, the present invention provides a process for treating synthetic/cellulosic fibre mixed textile substrates which have been dyed or printed with at least one disperse and at least one reactive dye comprising, after fixation, reductively treating the dyed or printed substrate at a neutral to alkaline pH with an aqueous solution containing a reducing agent selected from the group consisting of sodium formaldehyde sulphoxylate, sodium hydrogensulphide, sulphides, sulfites ($SO_3^{--}$), polysulphides, glucose, fructose, lactose and dextrine, the rH value of said solution being selected from a value of from 0 to 30, such as to decompose non-bound disperse dyestuff and render it colourless and/or decompose it such that it does not re build-up on the substrate whilst leaving the fixed reactive dyestuff substantially unaffected.

By synthetic/cellulosic fibre mixed textile substrates is to be understood substrates of polyester and natural or regenerated cellulose, of cellulose 2$^1$/2 acetate and natural cellulose, and of cellulose triacetate and natural cellulose. Preferably, the substrate to be treated by the process of the invention is a polyester/cotton mixed substrate.

Treatment may be effected for example by immersing, padding, printing or spraying the substrate in or with an aqueous medium containing reducing agent; preferably treatment is effected by immersing the substrate in a treatment bath.

A general condition for the disperse dye is that the non-fixed disperse dye particles are quickly decomposed and that the decomposition products have a very small or practically negligible affinity for cellulose or polyester and thus do not build-up again on the substrate during the treatment. Disperse dyes which are suitable for the process of the invention are those which, when treated at the boil for 5 minutes in a solution containing 2 g/l sodium formaldehyde-sulphoxylate, 2 ml/l caustic soda 36° Bé, at least $1.0\times10^{-4}$ mol/l of said disperse dyestuff and a white polyester/cotton fabric will show no staining or coloration on said fabric after rinsing in running water. Such disperse dyestuffs include those of the nitro-, aminoketone-, ketoimine-, methine-, azomethine-, nitrodiphenylamino-, quinoline-, aminonaphthocumarine-, azo- and anthraquinone series.

Especially suitable are azo dyes, in particular monoazo dyes, with those azo dyes which have a (lower)alkoxycarbonyl(lower)alkyl-, (lower)alkylcarbonyloxy(lower)alkyl- or cyano(lower)alkyl-amino group in the coupling component being especially suitable. Also very suitable are anthraquinone dyes which have a (lower)alkoxycarbonyl(lower)alkylamino or (lower)alkylcarbonyloxy(lower)alkylamino group.

By "lower" as used herein is meant alkyl and alkoxy radicals having 1 to 6 carbon atoms. The preferred lower alkyl and alkoxy radicals having 1 to 4, especially 1 to 2 carbon atoms.

Representative disperse dyes which may be treated in accordance with the process of the present invention are C.I. Disperse Yellow 42, C.I. Disperse Yellow 49, C.I. Disperse Yellow 126, C.I. Disperse Yellow 202, C.I. Disperse Red 72, C.I. Disperse Red 74, C.I. Disperse Red 107, C.I. Disperse Red 202, C.I. Disperse Red 306, C.I. Disperse Violet 77, C.I. Disperse Blue 75, C.I. Disperse Blue 79, C.I. Disperse Blue 176, C.I. Disperse Blue 177, C.I. Disperse Blue 257 and C.I. Disperse Blue 286.

A general condition for the reactive dyestuff is that, when fixed on the substrate, it is not affected by the reductive treatment of the unfixed disperse dye. Suitable reactive dyestuffs are those which will undergo a reduction in depth of shade which is no greater than to a value 4–5 on the grey scale when subjected to any of the specific screening methods 1 and 2 described hereafter:

1. A chequered standard depth print made on cotton or cotton/polyester fabric with a reactive dye is treated after fixation for 5 to 10 minutes at 90° to 95° C. with 2 g/l sodium formaldehyde sulphoxylate and 2 ml/l caustic soda 36° Bé in a rotatable bath at liquor-to-goods ratio of 40:1.

2. A standard depth print made on cotton or polyester/cotton fabric with a reactive dye is treated, after fixation, for 5 to 10 minutes at 60° C. with 2 ml/l sodiumhydrogen sulphide and 2 ml/l caustic soda 36° Bé in a rotatable bath with a liquor to goods ratio of 40:1.

Such reactive dyestuffs include reactive dyes of the azo (monoazo, polyazo and metalazo)-, anthraquinone-, formazane-, triphenyldioxazine- and phthalocyanine series having at least one fibre reactive group. Examples of suitable dyes are those having at least one reactive group selected from vinylsulphonyl, sulphatoethylsulphonyl, sulphatoethylsulphonamido, thiosulphatoethylsulphonamido, sulphatoethylsulphonacrylamido, methyltaurinoethylsulphonylacrylamido, α-haloacrylamido, chloropropylamido, sulphatopropylamido, haloglacialaceticacidamido, mono- and di halo-1,3,5-triazinyl, trichloropyrimidinyl, monochlorodifluoropyrimidinyl, methylsulphonylchloromethylpyrimidinyl, dichloroquinoxalinyl and dichloropyrazinyl radicals. Also suitable are dyes having reactive groups derived from halocarboxylic acids, especially chloroacetyl, β-chloropropionyl, α-β-dibromopropionyl and α,β-dichloropropionyl radicals.

Especially suitable reactive dyes are those which have a good fixation yield, very good solubility, low substantivity and good retention of fixed dye on the fabric.

As stated above, the reductive treatment is carried out at a neutral to alkaline pH, i.e. at a pH from 7 to 14. Preferably, the treatment is effected at an alkaline pH, more preferably at a pH from 10 to 13. The choice of the pH depends on the reducing agent and the dyestuffs employed. For example when sodium formaldehyde sulphoxylate is used, the treatment is preferably carried out at a pH from 10 to 12.5. When using strong alkali it should be considered that, whilst the removal of the hydrolysable disperse dye may be accelerated, the stability of the bond between some reactive dyes and the fibre and the properties of polyester itself may be deleteriously affected. Suitable agents for adjusting the pH include sodium or potassium hydroxide, sodium or potassium carbonate and trisodium phosphate.

Examples of sulphites or sulphides used as reducing agents are sodium sulphite ($Na_2SO_3$), sodium sulphide, ammonium sulphide etc.. Preferred reducing agents are sodium formaldehyde-sulphoxylate and glucose.

The amount of reducing agents can vary depending on factors such as the rH value, the type of dyestuffs used the temperature, the depth of dyeing, etc.. Suitably the treatment bath contains the reducing agent in amounts of from 0.1 to 10 g/l, preferably 0.5 to 5 g/l.

The rH value, which is a measure of the reducing power of an aqueous solution, is defined by the variables redox potentials, pH value and temperature of the solution. The necessary rH value to achieve the reductive decomposition of the non-fixed disperse dye whilst leaving the fixed reactive dye intact depends on the dyestuffs used. The rH value is adjusted by regulating the above-mentioned parameters. Further variables of the reducing power are the treatment time and the nature and concentration of the reducing agent.

The calculation of the rH value may be made in accordance with the following Clark formula, $$rH = \frac{Uabs}{0.0992 \cdot (273.16 + t\,°C.)} + 2pH$$

where t°C. is the temperature of the solution Uabs=Ugem-+Uref where

Ugem is the measured potential, for example for a Platinum electrode with a reference electrode e.g. Ag/AgCl electrode in KCl(3 M), Uref is the potential of the standard electrode (in relation to a hydrogen electrode).

The potential of several standard electrodes are known, for example for Ag/AgCl in KCl (3 M) the potential is 260.918—(0.683. t°C.). Thus, for a system containing a platinum electrode in combination with a Ag/AgCl reference electrode in KCl(3 M) the rH value is given by the following formula:

$$rH = \frac{Ugem + 260 \cdot 918 - (0.683 \cdot t\,°C.)}{0.982\,(273.16 + t\,°C.)} + 2pH$$

Generally, redox-systems with very low rH values of from 0 to 5, that is with relatively high reduction power, can be used only when reactive dyes having a special resistance to reduction are present. Reduction systems with high rH values, for example 15 to 30, which have low reduction power may be used when the disperse dye present is easily reducible or is saponifiable with alkali.

The rH value of the reduction system is preferably from 1 to 20. However, with systems having a medium reducing power i.e. having rH values of from 3 to 20 the choice of dyestuffs is optimal. The most preferred rH values are from 3 to 10.

Depending on the reducing agent employed, the higher the temperature of the treatment bath, the higher the reduction power. For example reduction systems based on sodium formaldehyde sulphoxylate exhibit a marked increase in reduction power with rising temperature, the optimum reduction power of which systems only being reached at the boil. However, with other reducing agents, the optimal reduction strength is already reached at room temperature. The choice of reducing agent and of the temperature of the treatment will depend on the type of dyestuffs present, as in some cases at higher temperatures the reduced dyestuff may go onto the fibre again and cause undesired colouration of the white parts of a print or undesired clouding of light shades. Therefore, in some cases, the reductive treatment is advantageously carried out discontinuously in several baths optionally having successively increasing temperatures, in order to enable the quickest possible removal of unbound dyestuff and of thickeners whilst preventing the reassembly of the destroyed dye particles and their re-build-up on the substrate. The temperature(s) of the treatment bath(s) may vary from 10° to 120° C., and is preferably from 30° to 100° C., more preferably from 30° to 80° C. When the substrate is printed with the reducing system it may be stored at room temperature or subjected to a short treatment (i.e. up to 10 minutes) with saturated steam.

The treatment time in the reduction bath depends on the reduction system, the depth of dyeing and the amount of print and the dyestuff used. Generally the treatment time is between 5 seconds and 1 hour. For the treatment in one bath the treatment time is preferably between 1 and 10 minutes, more preferably between 1 and 5 minutes. In the multi-bath treatment, the treatment time generally totals from about 5 minutes to 40 minutes, preferably 5 to 30 minutes, with about 20 minutes being most preferred.

The treatment may be continuous or discontinuous. When the treatment is carried out in a continuous process the reduction baths should be periodically controlled and adjusted where necessary. The control of the reduction potential of the baths may be made using conventional redox indicators.

It is advantageous to rinse the dyed and fixed textile substrate with cold water to remove excess unfixed dyestuff, fixing agents and thickeners before and after subjecting the substrate to the reductive treatment. As stated above, the reductive treatment may be effected in several baths, in which case the substrate may also be subjected to intermediate rinsing and washing processes.

It is advantageous to employ 0.5 to 2 g/l of a conventional organic detergent in the reduction bath(s) (and in the wash baths when employed) in order to increase the washing out of and prevent the re take-up of the reduced reaction products.

The treatment may also be carried out in the presence of water softeners and/or complex forming agents, e.g. ethylenediaminetetraacetic acid sodium salt (EDTA).

The process according to the present invention may be used for treating textile substrates which have been dyed or printed with at least one disperse dye and at least one reactive dye by any of the known dyeing and printing methods. Suitably, dyeing with the reactive and disperse dye(s) may be carried out simultaneously.

The process according to the present invention, by decomposing any non-fixed disperse dye and possibly non-bound reactive dye, reduces the amount of normal washing of dyeings and prints and thus saves water and energy. Furthermore, the quality of the dyeings and prints is improved as non-fixed dyestuff is removed and thus results in dyeings being obtained which are more brilliant and exhibit improved wet fastnesses. In some cases the light fastness is also improved. In the case of prints, undesired staining of the white parts or of the lighter shade parts with dyestuff present in the wash baths may be avoided.

The following Examples further serve to illustrate the invention. In the Examples the parts and percentages are by weight and the temperatures are in degrees Centigrade.

EXAMPLE 1

A tone-in-tone print on polyester/cotton 67:33 is made as follows:

| | A printing paste containing: |
|---|---|
| 36 | parts of C.I. Disperse Orange 30 (liq. 50%) |
| 7 | parts of C.I. Disperse Red 167 (liq. 50%) |
| 20 | parts of C.I. Disperse Blue 79 (liq. 50%) |
| 23 | parts of C.I. Reactive Orange 62 |
| 1.5 | parts of C.I. Reactive Red 119 |
| 12.5 | parts of C.I. Reactive Blue 104 |
| 450 | parts of "Manutex F" 8% (commercial thickener) |
| 80 | parts of urea |
| X | parts of water |
| 10 | parts of sodium bicarbonate |
| 10 | parts of a reduction stabilizer e.g. "Revatol S" |
| 1000 | parts of printing paste is produced by mixing and stirring. |

The mixed fabric is printed with this printing paste on a stencil printing machine, then dried as usual and subjected for 6 minutes to superheated steam fixation at 175°. It is subsequently further treated on a washing machine as follows:

It is firstly rinsed cold in an overflow followed by a boiling treatment, at a liquid/goods ratio of 40:1, with water containing 3 ml/l of caustic soda 36° Bé and 2 g/l of Na-formaldehyde sulphoxylate, for 4 minutes. The treatment bath has a rH value between 3.0 and 4.5.

It is then neutralised with acetic acid. Finally, it is rinsed cold and then dried.

A brilliant print having a dark brown shade, with a pure white base is obtained. The print possesses good wet-fastness and rubbing-fastness.

Instead of the one treatment at the boil the textile may be treated in several baths having lower temperatures; with treatment at 40° the rH value is between 16.5 and 18 and the pH of 11.8 with treatment at 60° the rH value is between 12.5 and 13.5 and the pH of 11.5, and with treatment at 80° the rH value is between 6.0 and 8.5 and the pH of 11.1.

A liquor ratio of 20:1 instead of 40:1 also gives similar results.

Equally good results may be obtained using 5 g/l of sodium carbonate instead of 3 ml/l of caustic soda 36° Bé. Instead of using the superheated steam fixation method for 6 minutes at 175°, the printed textile material may also be fixed for 1 minute in dry heat at 210°, whereby again equally good results are obtained.

When the treatment baths additionally contain water softeners (depending on the degree of hardness) similar results are obtained.

EXAMPLE 2

Continuous tone-in-tone dyeing on polyester/cotton 67:33 with disperse and reactive dyestuffs. Using a dyestuff mixture containing:

33 parts of C.I. Disperse Red 167
36 parts of C.I. Reactive Red 147
11 parts of C.I. Reactive Orange 62 a single-bath, one-stage continuous dyeing process is set up with the following padding liquor composition:

40 g/l of disperse/reactive dyestuff mixture
60 g/l of urea
8 g/l of sodium bicarbonate
10 g/l of common salt
20 g/l migration inhibitor e.g. "Sandapol AM" liquid.

The liquor is cold padded with a dry weight increase of 70%, the textile is then dried. Subsequently, the textile material is subjected to thermosol treatment for 60 seconds at 210° and is subjected to aftertreatment as described in Example 1.

A dyeing having a brilliant red shade which is dyed tone-in-tone is obtained.

EXAMPLE 3

Instead of the disperse dyestuff mixture used in Example 1, 31.5 parts of C.I. Disperse Blue 79 are used, and instead of the reactive dyestuff mixture used in Example 1, 36 parts of C.I. Reactive Blue 104 and 3 parts of CI Reactive Blue 105 are used. A dark blue print is obtained, which has an advantageous resist of the white unprinted parts. The print has good wet fastness. Instead of the aftertreatment described in Example 1, a continuous wash process may be used, e.g. rinsing cold in a first wash bath, in a second wash bath treating it for 60 seconds at 40° with 2 g/l of "Lyogen DFT" (dispersing agent), in a third wash bath treating it for 3 minutes with 3 g/l of Na-formaldehyde sulphoxylate and 3 ml/l of caustic soda 36° Bé at 80° (rH value between 8 and 10 and pH of 11.1), in a fourth wash bath neutralizing with acetic acid and in a fifth wash bath rinsing cold.

Similar results are obtained by additionally using a non-ionic detergent in the third wash bath.

EXAMPLE 4

As well as the possibility of effecting the reductive treatment during the washing processes, the process may be effected as follows:

The solution containing reduction agents is applied to the textile substrate after fixation. Then the dyeings, are treated either whilst wet, partly or completely dry, by storing the goods at room or higher temperature or by treating them with steam or with other sources of energy. Subsequently, the washing-out process is effected so as to remove, the unfixed, decomposed dyestuff particles, chemicals and dyeing additives.

The application of the solution containing a reduction agent may be effected by a 1000 point roller, fully-engraved flat or round stencil, a spraying apparatus or a slop-padder. The amount of the reduction system to be applied and the subsequent treatment method are selected such that only the unfixed dyestuff particles are destroyed.

A polyester/cotton 67/33 mixed fabric is printed and fixed as described in Example 1. A thickened solution containing 20 g/l of carob bean flour derivative and
2 g/l of glucose in water is subsequently applied by a 1000 point roller. The dry weight increase is 70%. The substrate is then dried and treated for 5 minutes in saturated steam at 102°. Finally, the fabric is rinsed in cold water, soaped at 60° to boiling point with a solution containing 0.5 g/l of a non-ionic washing agent, rinsed again and finally dried. A vivid dark-brown print is obtained having good fastnesses whereby the unprinted parts remain practically pure white. Equally good results are obtained by using instead of the 2 parts glucose 2 g/l of sodium-formaldehyde sulphoxylate and
3 ml/l of NaOH 30° Bé.

EXAMPLE 5

A print on polyester/cotton 67:33 was made with a printing paste as described in Example 1 except that in place of the disperse dye mixture mentioned in Example 1, 15 parts of C.I. Disperse Yellow 126 are used and instead of the reactive dyestuff mixture mentioned in Example 1, 30 parts of C.I. Reactive Yellow 25 are used.

After the print is rinsed cold in an overflow an aftertreatment at a liquor to goods ratio of 40:1 is effected for 5 minutes at 60° with a solution containing 2 g/l sodium hydrogensulphide (NaHS), 2 ml/l caustic soda 36° Bé, the measured rH value being between 12.5 and 13.5 and the pH 11.9, followed by neutralisation and rinsing cold. The sodium hydrogensulphide may be present in a mixture of sulphides in water.

Similar results are obtained if 5 g/l sodium carbonate are used instead of 2 ml/l caustic soda. The measured rH value of such solution is also between 12.5 and 13.5 and the pH 11.2. Alternately 5 g/l of trisodium phosphate may be used in place of the sodium carbonate, in which case the rH value is between 12 and 13 and the pH 11.5.

A treatment temperature of 95° instead of 60° with varying alkali systems and practically the same rH value also gives similar results.

EXAMPLE 6

A print is made as described in Example 1 with the exception that instead of the disperse dye mixture of Example 1, 24 parts of C.I. Disperse Yellow 126 (liquid 50%) and 40 parts of C.I. Disperse Red 72 (liquid 50%) are used and instead of the reactive dyestuff mixture of Example 1, 24 parts of C.I. Reactive Yellow 25, 1.8 parts C.I. Reactive Orange 64 and 6.2 parts Reactive Red 147 are used.

The aftertreatment is carried out as follows:

The fabric is rinsed cold and treated at a liquor to goods ratio of 40:1 for 5 minutes in three baths each containing 3 g/l glucose, 5 g/l sodiumcarbonate, 0.5 g/l non-ionic surfactant and 1 g/l of a commercial water softener.

The treatment is commenced at 60° whereby the rH value is from 20 to 22. In the second bath where the temperature is 80° the rH value is between 14 and 16 and the pH 10.9. In the third bath the treatment is at 95°, the measured rH value is between 9 and 12.5 and the pH 10.7. Subsequently, the fabric is neutralized and rinsed in cold running water.

Similar results are obtained when 2 ml/l caustic soda 36° Bé are used in place of the 5 g/l sodiumcarbonate, practically the same rH values being obtained.

In place of the 3 g/l glucose, 3 g/l of fructose can be used in all the baths, whereby in the bath at 60° the rH value is between 20 and 22, in the bath at 80° it is between 14 and 17 and in the bath at 95° it is between 9 and 11.5.

Instead of fructose, 3 g/l lactose may be used whereby the rH values of the baths at 60°, 80° and 95° are between 20 and 22, 15 and 18 and 9 and 13, respectively.

Instead of lactose, 3 g/l of dextrin may be used whereby the rH values of the baths at 60°, 80° and 95° are between 20 and 22, 18 and 20 and 10 and 15, respectively.

EXAMPLE 7

A print is made as described in Example 1 with the exception that 6 parts C.I. Disperse Yellow 126 and 14 parts C.I. Disperse Blue 176 are used instead of the disperse dyestuff mixture of Example 1, and 8 parts of C.I. Reactive Yellow 25 and 8 parts C.I. Reactive Blue 105 are used instead of the reactive dyestuff mixture of Example 1.

The fabric is then rinsed in water and is then treated in aqueous solution containing 1 g/l sodium formaldehydesulphoxylate, 1 g/l glucose and 2 ml/l caustic soda 36° Bé. The treatment is carried out at 60°, 80° and at the boil whereby the rH values are between 13 and 16, 7 and 9, and 5 and 6.5, and the pH values are 11.7, 11.4 and 11.0, respectively.

The same results can be obtained by treatment in baths at 40° and 60° which only contain conventional washing and dispersing agent or a non-ionic detergent, followed by treatment in the baths at 80° and at the boil in the presence of the above described reducing mixture.

EXAMPLE 8

A print on polyester/cotton 67:33 is made in conventional manner with a printing paste containing:

| | | |
|---|---|---|
| 28 | Parts C.I. Disperse Yellw 126 | all in liquid form (50%) |
| 42 | Parts C.I. Disperse Red 72 | |
| 70 | Parts C.I. Disperse Blue 286 | |
| 53 | Parts C.I. Reactive Black 34 | |
| 7 | Parts C.I. Reactive Orange 62 | |
| 500 | Parts Manutex F, 8% (commercially available thickener) | |
| 50 | Parts urea | |
| 10 | Parts sodium carbonate | |
| 10 | Parts reduction stabilizer, e.g. "Revatol S", and water to make the paste up to 1000 parts. | |

The printed material is rinsed cold and is treated for 5 minutes in a bath at 40°, then in a bath at 60°, then in a bath at 80° and finally in a bath at 95°, at a liquor to goods ratio of 40:1 with each of the baths containing 2 g/l sodium formaldehydesulphoxylate, 2 ml/l caustic soda 32° Bé, 1 g/l water softener and 0.5 g/l of a washing or dispersing agent. The bath at 40° has a rH value between 18 and 20, and a pH of 12.1, the bath at 60°, a value between 12 and 16 and a pH of 11.8, the bath at 80°, a value between 6 and 9 and a pH of 11.4 and the bath at 95°, a value between 4.5 and 6 and a pH of 11.2. Subsequently, the fabric is neutralized and rinsed in running water. A deep black print with a white background is obtained. The print has good wet fastness.

The residue of reducing agent in each bath is measured. In order to assess the percentage of used reducing agent a titration is made, or alternatively a potentiometric titration may be made whereby the turning point between the reducing power and oxidation power may be read off.

Taking the amount of reducing agent at the beginning of treatment in each bath as being 100% and conducting a titration after the treatment in each bath, it is found that the amount of the residual reducing agent present after treatment at 40° is 99%, after treatment at 60° is 98%, after treatment at 80° is 95% and after treatment at 95% is 90%.

Equally good results are obtained when, instead of a liquor to goods ratio of 40:1, it is raised from 20:1 to 100:1.

What we claim is:

1. A process for treating a synthetic/cellulosic fibre mixed tensile substrate which has been dyed or printed with at least one disperse and at least one reactive dye and which contains no resin protection for the fixed reactive dye comprising, after fixation, reductively treating the dyed or printed substrate at a neutral to alkaline pH with an aqueous solution containing a reducing agent selected from the group consisting of sodium formaldehyde sulphoxylate, sodium hydrogensulphide, sulphides, sulfites ($SO_3^{--}$), polysulphides, glucose, fructose, lactose and dextrine, the rH value of said solution being selected from a value of from 0 to 30, such as to decompose non-bound disperse dyestuff and render it colourless, decompose it such that it does not re build-up on the substrate, or both whilst leaving the fixed reactive dyestuff substantially unaffected.

2. A process according to claim 1, in which the pH is from 10 to 13.

3. A process according to claim 1, in which the disperse dye is one which, when treated at the boil for 5 minutes in a solution containing 2 g/l sodium formaldehyde-sulphoxylate, 2 ml/l caustic soda 36° Bé, at least $1.0\times10^{-4}$ mol/l of said disperse dyestuff and a white polyester/cotton fabric will show no staining or coloration on said fabric after rinsing in running water.

4. A process according to claim 1, in which the disperse dye is an azo or anthraquinone dye containing an alkoxycarbonylalkylamino or alkylcarbonyloxyalkylamino group or an azo dye containing a cyanoalkylamino group, the alkoxy and alkyl portions of said groups containing 1 to 6 carbon atoms.

5. A process according to claim 1, in which the disperse dye is selected from: C.I. Disperse Yellow 42, C.I. Disperse Yellow 49, C.I. Disperse Yellow 126, C.I. Disperse Yellow 202, C.I. Disperse Red 72, C.I. Disperse Red 74, C.I. Disperse Red 107, C.I. Disperse Red 202, C.I. Disperse Red 306, C.I. Disperse Violet 77, C.I. Disperse Blue 75, C.I. Disperse Blue 79, C.I. Disperse Blue 176, C.I. Disperse Blue 177, C.I. Disperse 257 and C.I. Disperse Blue 286.

6. A process according to claim 1, in which the reactive dye is one which will undergo a reduction in depth of shade which is not greater than to a value 4–5 on the grey scale when subjected to specific screening method 1 or 2 .

7. A process according to claim 1, in which the reducing agent is selected from the group consisting of sodium formaldehydesulphoxylate and glucose.

8. A process according to claim 1, in which the rH value is from 1 to 20.

9. A process according to claim 1, in which the rH value is from 3 to 20.

10. A process according to claim 1, in which the substrate is polyester/cotton.

11. A process according to claim 1, in which the substrate is printed with an aqueous solution containing a reducing agent.

12. A process according to claim 11, in which the substrate is subsequently stored at room temperature or treated with saturated steam followed by rinsing and washing.

13. A process according to claim 1, in which the substrate is immersed, padded or sprayed in or with an aqueous medium containing a reducing agent.

14. A process according to claim 13, in which the substrate is rinsed with cold water prior to the treatment in or with the medium containing reducing agent.

15. A process according to claim 1, in which the substrate is immersed in a plurality of baths each containing reducing agent.

16. A process according to claim 14, in which the substrate is rinsed in cold water prior and subsequent to the treatment in the baths containing reducing agent.

17. A process according to claim 1 wherein the reducing agent is present in the aqueous solution in an amount of 0.1 to 10 g/l.

18. A process according to claim 1 wherein the substrate is reductively treated for a period of 5 seconds to 1 hour.

19. A process according to claim 3 wherein the reactive dye is one which will undergo a reduction in depth of shade which is not greater than to a value 4–5 on the grey scale when subjected to specific screening method 1 or 2.

20. In a process wherein a polyester-containing substrate is dyed with a disperse dye and, after fixation of the dye, is treated with a reducing agent to decompose unfixed disperse dye, the improvement wherein the reducing agent is glucose, fructose, lactose or dextrine.

21. A process according to claim 20 wherein the reducing agent is glucose.

22. A process according to claim 19 wherein the substrate is mixed polyester/cotton which has been dyed with a disperse dye which is an azo or anthraquinone dye containing an alkoxycarbonylalkylamino or alkylcarbonyloxyalkylamino group or an azo dye containing a cyanoalkylamino group, the alkoxy and alkyl portions of said groups containing 1 to 6 carbon atoms, and with a reactive dye having at least one reactive group selected from the group consisting of vinylsulphonyl, sulphatoethylsulphonyl, sulphatoethylsulphonamido, thiosulphatoethylsulphonamido, sulphatoethylsulphonacrylamido, methyltaurinoethylsulphonylacrylamido, α-haloacrylamido, chloropropylamido, sulphatopropylamido, haloglacialaceticacidamido, mono- and dihalo-1,3,5,-triazinyl, trichloropyrimidinyl, monochlorodifluoropyrimidinyl, methylsulphonylchloromethylpyrimidinyl, dichloroquinoxalinyl, dichloropyrazinyl, chloroacetyl, β-chloropropionyl, α-β-dibromopropionyl and α,β-dichloropropionyl radicals and the reductive treatment is carried out for a period of 5 seconds to 1 hours with an aqueous solution having a pH of 10 to 13 and containing the reducing agent in an amount from 0.1 to 10 g/l.

23. A process according to claim 22 wherein the sulfite is sodium sulfite and the sulphides are sodium sulphide and ammonium sulphide.

* * * * *